US008246047B1

(12) United States Patent
Sekine

(10) Patent No.: US 8,246,047 B1
(45) Date of Patent: Aug. 21, 2012

(54) DISPLAY FOR GAME AND GAMING MACHINE

(75) Inventor: Yasuyuki Sekine, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 2151 days.

(21) Appl. No.: 09/208,696

(22) Filed: Dec. 10, 1998

(30) Foreign Application Priority Data

Dec. 10, 1997 (JP) ..... 9-340193

(51) Int. Cl.
*G07F 17/34* (2006.01)

(52) U.S. Cl. ..... 273/143 R

(58) Field of Classification Search ..... 273/134 R, 273/145

See application file for complete search history.

(56) References Cited

U.S. PATENT DOCUMENTS

| | | | | | |
|---|---|---|---|---|---|
| 4,051,939 | A | * | 10/1977 | Murphy et al. | 194/211 |
| 4,184,683 | A | * | 1/1980 | Hooker | 273/143 R |
| 4,618,150 | A | * | 10/1986 | Kimura | 273/138.2 |
| 4,635,937 | A | * | 1/1987 | Dickinson et al. | 273/143 R |
| 4,657,256 | A | * | 4/1987 | Okada | 463/21 |
| 4,695,053 | A | * | 9/1987 | Vazquez et al. | 463/18 |
| 5,209,479 | A | | 5/1993 | Nagao et al. | |
| 5,393,057 | A | | 2/1995 | Marnell, II | 273/85 |
| 5,413,342 | A | | 5/1995 | Kaplan | 273/143 |
| 5,456,465 | A | | 10/1995 | Durham | 273/138 |
| 2003/0232640 | A1 | * | 12/2003 | Walker et al. | 463/16 |

FOREIGN PATENT DOCUMENTS

| | | | | |
|---|---|---|---|---|
| CH | 561 074 | | 4/1975 | |
| EP | 0 558 307 | | 9/1993 | |
| JP | U62-84485 | | 5/1987 | |
| JP | 2-49681 | | 2/1990 | |
| JP | 5-74391 | | 10/1993 | |
| JP | 405068733 | * | 2/1994 | 273/143 R |
| JP | 406047129 | * | 2/1994 | 273/143 R |
| JP | 7-116313 | | 5/1995 | |
| JP | 7-231974 | | 9/1995 | |
| JP | 9-122320 | | 5/1997 | |
| WO | WO 93/12849 | * | 7/1993 | 273/143 R |

* cited by examiner

*Primary Examiner* — Alvin Hunter
*Assistant Examiner* — Dolores Collins
(74) *Attorney, Agent, or Firm* — Edwards Wildman Palmer LLP

(57) ABSTRACT

A display for a game is provided with a display portion that provides indication of a plurality of movable symbols that are necessary for playing the game, and which are moved in a determined direction. A special kind of symbol, among the plurality of symbols, is associated with a predetermined game condition, such as a win or a loss, and is displayed in the display portion two or more identical symbols being caused to appear serially on the display portion. When two or more such identical symbols appear in sequence, even if the symbols are moved at a fairly high rate of speed, the player can distinguish such repetition of a symbol in the sequence, and thereby identify the special symbol. With knowledge of the identity of the special symbol, the player can relatively easily execute a stop motion operation with good timing.

16 Claims, 6 Drawing Sheets

DISPLAY FOR GAME AND GAMING MACHINE

BACKGROUND OF THE INVENTION

1. Field of the Invention

This invention relates to displays used in gaming machines such as pachinko gaming machines or slot machines having mechanical displays, such as rotation reels with associated indication portions that provide indication of symbols including various figures, designs, letters, or the like, or having electric displays, such as liquid crystal displays, CRTs, plasma displays, or electro-luminescent elements, and additionally relates to gaming machines, such as ball-shooting gaming machines, slot machines, or TV game machines.

2. Description of the Related Art

A gaming machine such as a slot machine usually has an associated mechanical variable display formed of rotatable display elements that are provided with a plurality of symbols disposed on peripheral surfaces thereof. The symbols are visible through a display window at the front of the slot machine. Alternatively, an electrical variable display is formed of indicating elements with symbols on a display screen. In response to a "start" operation by a player, a controller that includes a CPU controls a drive of the variable display to start the rotation of each rotatable display element and to stop such rotation automatically in accordance with a determined sequence after a predetermined period of time has elapsed, or in response to the initiation of a "stop" operation by the player. When the rotation of all of the rotatable display elements has ceased, there is shown a specific combination of symbols (winning pattern) in the display window. The player is then given an award by paying out gaming media such as coins. In a known gaming machine, a "win" corresponding to a predetermined plurality of winning symbols being completely positioned on the effective line of the display when rotation of the rotatable display elements ceases occurs only when a win has been established by a system that is internal to the gaming machine. In a practical machine, this happens when a sampling operation of a random number issued by a microcomputer has been determined to constitute a win.

Such gaming machines have become popular because the particular symbols that appear on the display when the rotatable display elements are stopped do not depend on the skill of the player. If such stopping of the rotatable display elements were to depend completely on the stop operation, or timing, of the player, the end result (i.e., winning or losing) of the game would be responsive to the skill of the player. If such were the case, only the relative abilities of the players would be emphasized, and the wholesomeness of the game would be compromised. A further reason for the popularity of such machines is that their designers have solved a number of problems related to management of the pay out rate of the coins for amusement shops. Accordingly, even a gaming machine of the type in which the player can effect a stop operation, as might be the case in a slot machine having stop buttons, the player cannot cause a winning pattern to be arranged on an effective line unless a win has been established by the internal system. Consequently, it is quite difficult for a player to use skill to effect a desired game result in such a gaming machine.

On the other hand, the above-mentioned gaming machine suffers from the disadvantage that even if a player has gained experience and thereby obtained a high degree of skill, the player's enhanced abilities or skill cannot effect a desired game result, and consequently, the appeal of the game to such a player is diminished. For this reason, the prior art has provided gaming machines wherein a desired game result can be achieved by a player in response to the stop operation under a predetermined game condition.

One such gaming machine, in the form of a slot machine, is disclosed in Japanese patent publication No. 5-74391. In this known slot machine, when a specified condition is achieved in the progress of the game, the controller is regulated to stop the standstill control of at least one of the reels by extraction of a random number until a predetermined times of the game. The game condition where the standstill control is stopped is termed the "challenge time" (hereinafter referred to as "CT"). The period during which the game condition is maintained is termed the "CT period," and a game performed in the CT period is hereinafter termed the "CT game." A pattern (i.e., a combination of symbols) indicated when movement of the reels is stopped is determined by the timing of a stop operation, illustratively by manipulation of a push button by the player. Thus, the skill of the player can affect the result of the game.

More specifically, CT is a game condition that, irrespective of whether the determination responsive to the random number is performed, a winning pattern of symbols can be arranged as a stop pattern when the variable display is stopped in response to the stop operation by the player. Some gaming machines utilize a system wherein, during the CT period, the controller does not perform a determination of a small win, which the player rather easily can achieve, but instead will perform a determination regarding a big win, thereby making same more difficult for the player to achieve.

The CT period is started on the time when a predetermined open condition is established, and expires when a predetermined close condition is established. It is very difficult for a player, particularly a beginner, to distinguish between symbols because when the reels are rotated, the symbols indicated in the movement are seen as interfering with each other.

In a gaming machine in which the CT system is applied, the player cannot measure a good timing for actuation of a push button stop operation during the CT period. The CT game therefore sometimes ends without giving any merit to the player. A player who has achieved a higher level of skill and experience for the game can, in some cases, employ the push button stop operation during the CT period to affect wins. Nevertheless, the beginner will not enjoy the game as well as the expert does.

SUMMARY OF THE INVENTION

It is, therefore, an object of the invention is to provide a display for a game by which a beginner player can perform an effective stop operation more easily, whereby the beginner and the expert players can enjoy playing the game.

It is an other object of this invention to provide a gaming machine in which the principle element of playing the game constitutes the watching of the display for the game.

An object of the invention is to provide a display for game by which a beginner player can perform a top operation more easily and an expert player can also sufficiently enjoy games, and to provide a gaming machine in which the principle element of playing the game constitutes the watching of the display for the game.

According to the invention, there is provided a display for game having a display portion for movable indication of a plurality of symbols necessary for the game in a certain direction, wherein a special kind of symbol among the plurality of symbols is indicated in such manner that two or more identical symbols appear recognizably successively in the direction to be moved on the display portion for a player to perform an effective stop operation.

In the display portion, plural kinds of symbols necessary for the game are indicated while the display is moving. The player sometimes cannot easily distinguish the symbols from one another when the player watches the symbols moving at high speed.

According to the invention, a special kind of symbol is indicated in such manner that two or more of identical symbols one after another in the direction of movement of the display. When two or more identical symbols are appeared successively, even if the symbols are moved at a relatively high speed, the player can distinguish the special symbol as it is. As the result, for example, in the slot machine in which the CT is adopted, the player can carry out relatively easily top operation such as push button operation with good timing.

In the display for game according to the invention, a game state is established to be not advantageous to a player if the special kind of symbol is contained in a combination of symbols indicated on the display portion when movement of the symbols has been stopped. The player can easily see the special kind of symbol and can relatively easily carry out the stop operation with good timing not to indicate the symbol as a stop symbol.

In the display for game according to the invention, a game state is established to be advantageous to a player if the special kind of symbol is contained in a combination of symbols indicated on the display portion when movement of the symbols has been stopped. The player can relatively easily carry out the stop operation with good timing to indicate the symbol as a stop symbol and can realize an indication of combination of stop symbols advantageous to the player, for example, corresponding to "big hit," "middle hit" or "small hit."

In the display for game of this invention, first, second and third symbols among the special kind of symbols are indicated in such manner that two or more of identical symbols be appeared serially one after another in first, second and third columns, respectively, the first symbol being a constituent of a specified combination of symbols that is indicated on the display portion when movement of the symbols has been stopped, the second symbol being a constituent of another specified combination of symbols that is indicated on the display portion when movement of the symbols has been stopped, and the third symbol being a constituent of the other specified combination of symbols that is indicated on the display portion when movement of the symbols has been stopped. In this case, a player can recognize and distinguish the special kinds of symbols from the other symbols in the columns, respectively.

For example, in a display portion of a slot machine, when first symbol has been stopped at a predetermined position of first column, a player can comparatively easily obtain a win based on the first symbol combination by button-pushing operation so as to avoid second and third symbols, that are different symbols from the first symbol, in second and third columns, respectively.

Also, when the second symbol has been indicated standstill, the player can comparatively easily obtain a win based on the second symbol combination by button-pushing operation so as to avoid the first and third symbols, that are different symbols from the second symbol, in first and third columns, respectively.

Also, when the third symbol has been indicated standstill, the player can comparatively easily obtain a win based on the third symbol combination by button-pushing operation so as to avoid the first and second symbols, that are different symbols from the second symbol, in first and second columns, respectively.

In these cases, if the third symbol of the third column, for example, is the symbol that does not contribute to a win, the first symbol or the second symbol is easy to be arranged by a procedure to stop movement of the third column last.

In the display for game according to this invention, the special kind of symbol is distinguished by a special appearance from the other symbols, for example, specified color, specified size, specified displacement from centerline or the like.

Even if the special kinds of symbols are appeared in a manner that plurality of identical symbols are serially one after another, the special kinds of symbols are hard to be recognized because of in interaction between the other symbols if these symbols have same or resemble color as the other symbols have.

According to the display for game mentioned above, the special kinds of symbols are recognized by being distinct in specified colors from the other symbols even if these are moving.

When the special kinds of symbols are specified not only by color but also size smaller or larger than the other, position of displacement to left or right compared with the other symbols, easiness in recognition increases.

In the display for game according to this invention, the special kind of symbol is indicated in such manner that three or more of identical symbols be appeared serially one after another in the direction to be moved on the display portion. According to this embodiment, when movement indication of symbols is stopped, for example, in a slot machine, three symbols are usually indicated as stop symbols serially in the direction to be moved in the display portion. Consequently, it is also useful for making "hit" based on a combination of the special kind of symbols.

A gaming machine of this invention has a display portion for movable indication of a plurality of symbols necessary for game in a certain direction, wherein a special kind of symbol among the plurality of symbols is indicated in such manner that two or more of identical symbols be appeared serially one after another in the direction to be moved on the display portion.

According to this invention, a gaming machine having above-mentioned effect can be provided by utilizing a liquid crystal display or controller thereof that is used in a conventional gaming machine.

According to this invention, a gaming machine having above-mentioned effect can be provided by utilizing a liquid crystal display or controller thereof that is used in a conventional gaming machine.

BRIEF DESCRIPTION OF THE DRAWING

Comprehension of the invention is facilitated by reading the following detailed description, in conjunction with the annexed drawing, in which.

DETAILED DESCRIPTION OF A PREFERRED EMBODIMENT OF THE INVENTION

In the present specific illustrative embodiment of the invention, the invention is effected by a sheet (reel sheet) that is attached on a peripheral surface of a rotatable reel constituting a display portion of a slot machine, pachinko gaming machine, or the like.

Figure 1:
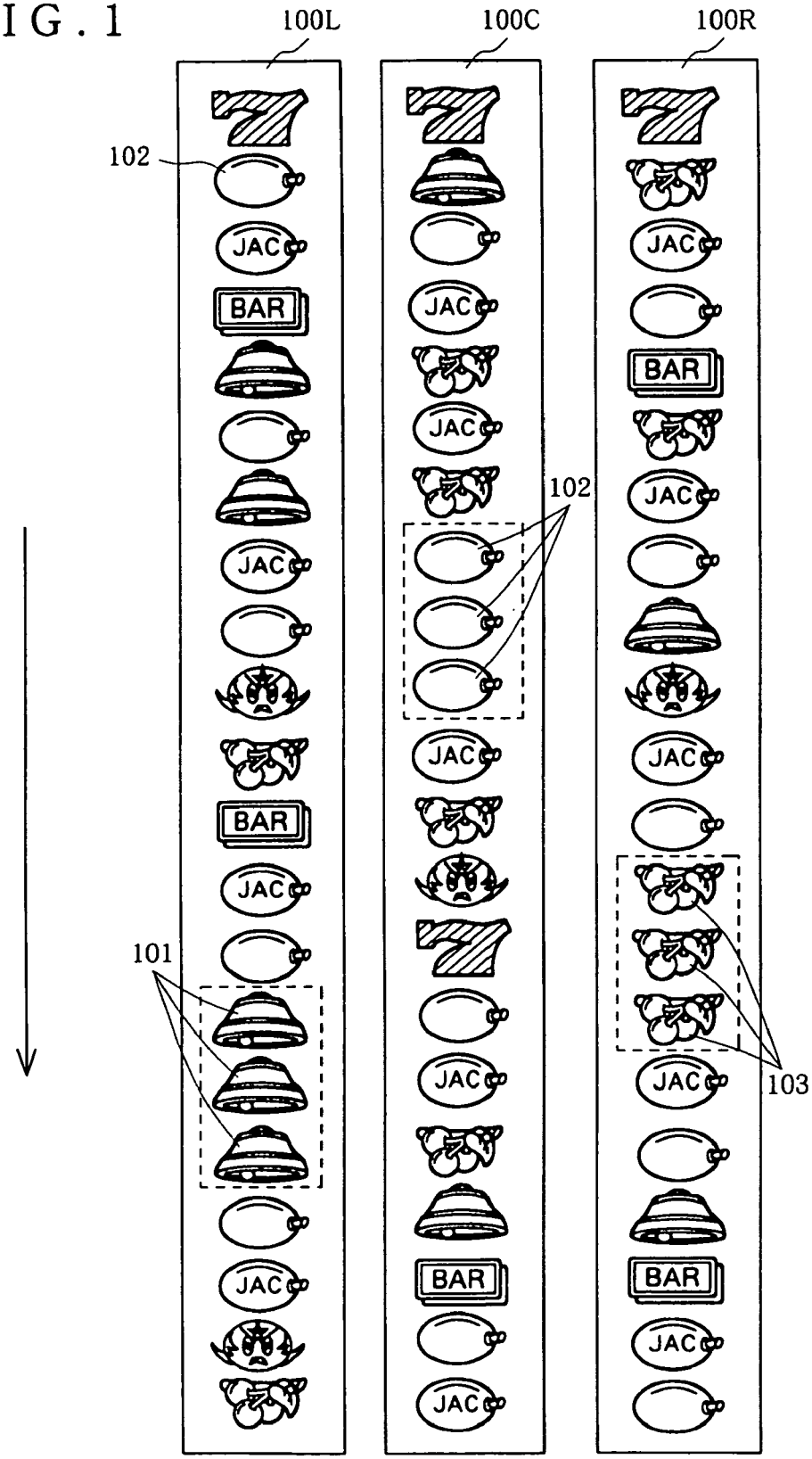
FIG. 1 is a plan view of three reel sheets showing a plurality of symbols arranged in accordance with a specific illustrative embodiment of the invention.

FIG. 1 shows three reel sheets 100L, 100C, 100R that are to be attached to respective peripheral surfaces of three rotatable reels (not shown). Several kinds of symbols are drawn on each reel sheet 100L, 100C, 100R and each symbol is arranged at a constant interval of distance with respect to each other.

On reel sheets 100L, 100C, and 1008, of FIG. 1, a plurality of symbols are arranged in a predetermined sequence as a symbol row drawn on each sheet. Since only a set of sequential three sequential "bell" symbols are arranged among 21 symbols in a symbol row of reel sheet 100L, the three "bell" symbols appear recognizably serially one after another once rotation of a reel that is provided with reel sheet 100L. Since only a set of three sequential "plum" symbols are arranged in the symbol row of reel sheet 100C, the three "plum" symbols appear recognizably serially one after another once rotation of a reel that is provided with reel sheet 100C. Also, since only a set of three sequential "cherry" symbols appear recognizably serially one after another once rotation of a reel that is provided with reel sheet 100R, the sequentially arranged special symbols recognizably appear and permit a player to perform an effective top operation.

Regarding special kinds of symbols, in this specific illustrative embodiment of the invention, three identical symbols are repeated sequentially in the direction of rotation of the reel (illustrated by the downward arrow) on each reel sheet 100L, 100C, 100R. More specifically, and as emphasized by the dotted lines in FIG. 1, on the first reel sheet 100L, three "bell" symbols 101 are grouped sequentially; on second reel sheet 100C, three "plum" symbols 102 are grouped sequentially; and on third reel sheet 100R, three "cherry" symbols 103 are grouped sequentially. When the reels (not shown) are rotated, the plural sequential special symbols are easily distinguished from the other symbols.

In this specific illustrative embodiment of the invention, each of the special symbols has an associated coloration. That is, "bell" symbol 101 is colored yellow, "plum" symbol 102 is colored blue, and "cherry" symbol 103 is colored red. The player can easily find each special symbol by detecting its associated color.

Figure 2:
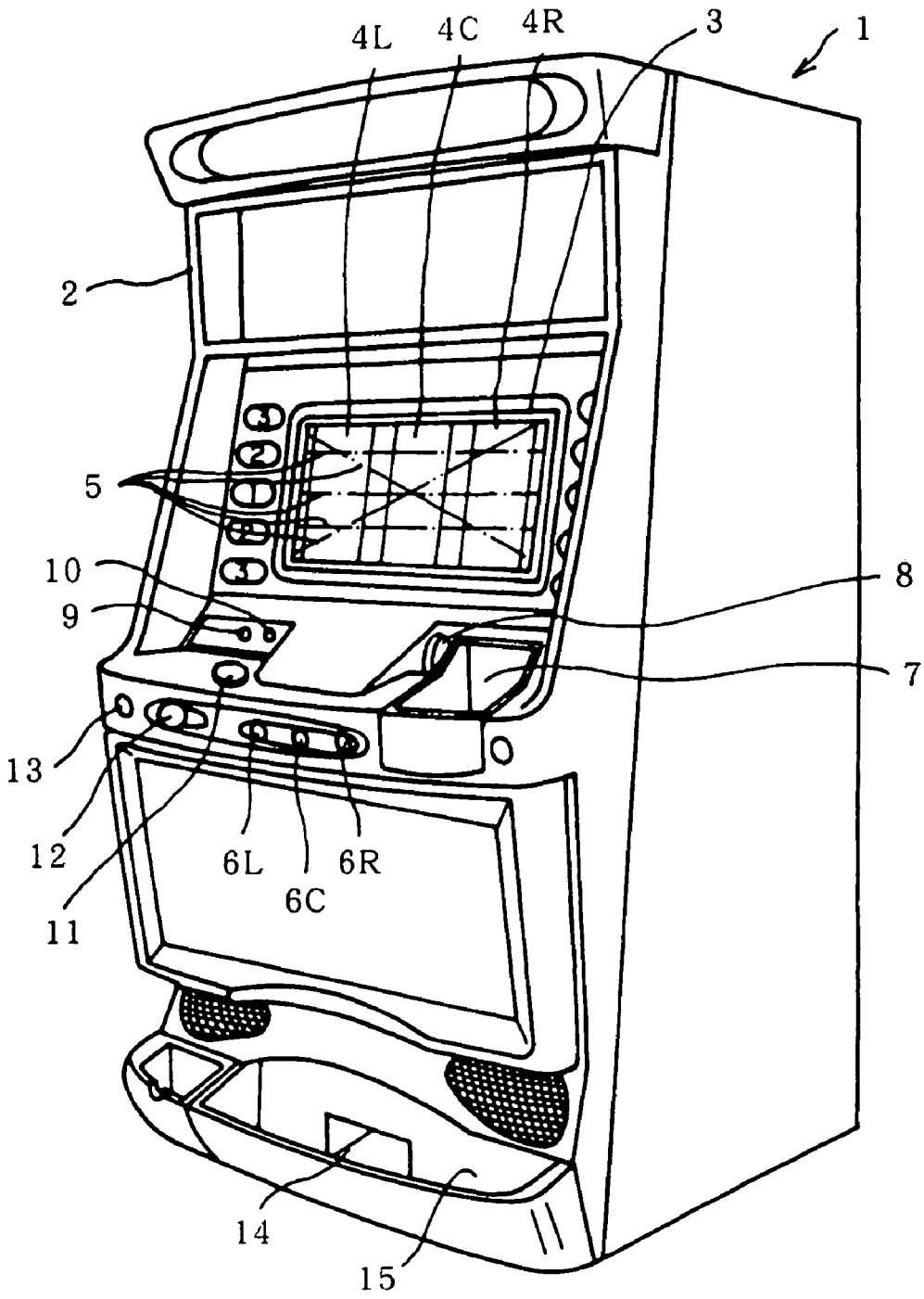
FIG. 2 is a perspective representation showing a front view of a specific illustrative embodiment of a slot machine constructed in accordance with the principles of the invention.

FIG. 2 is perspective representation showing the outer appearance of a slot machine 1, as a specific illustrative embodiment of a gaming machine according to this invention. Slot machine 1 is a gaming machine played by using a coin, a medal or a token and the like as a game medium (not shown). Hereinafter, the game medium (not shown) will be referred to as "medal."

In the front of a cabinet 2, which surrounds all of slot machine 1, a rectangular display window 3 is provided having width that is longer than its length. In this embodiment, display window 3 is arranged to be substantially. On display window 3 there are provided a plurality of winning lines 5, consisting of three horizontal lines and two diagonal lines. Additionally, there is shown to be provided a plurality of numerals, specifically 3, 2, 1, 2, 3 from top to bottom. These numerals are provided on the left and right (not specifically shown on the right-hand side) of display window 3.

When a "1-BET" switch 9, a "2-BET" switch 10, and a "maximum BET" switch 11 are operated, one, three, or five wining lines are made effective, respectively. The operation of "1-BET" switch 9, a "2-BET" switch 10, and a "maximum BET" switch 11 will be described hereinafter.

In cabinet 2, three rotatable reels 4L, 4C, 4R are arranged side-by-side. On the periphery surface of each reel is attached an associated one of reel sheets 100L, 100C, 100R having symbols drawn thereon shown in FIG. 1. The symbols are indicated in display window 3 sequentially by rotation of the reels. A variable display is constituted with these rotatable reels.

At the left side of the center of the front face of cabinet 2, a start lever 12 is provided for starting rotation of the reels by operation of the player is arcuately displaceable within a predetermined range of angular motion. At the right side below display window 3, there is disposed a bucket typed medal inlet 7 where a large number of medals can be inserted. At the left side of the inlet, there is disposed a switch 8 for automatically supplying medals to a credit portion (not shown).

Above start lever 12, there are disposed 1-BET switch 9 for betting only one medal, 2-BET switch 10 for betting two medals, and maximum BET switch 11 for betting a maximum number of medals among credited medals on a game to allow a one-time button-pushing operation. The above-mentioned winning lines 5 are made effective when these BET switches are respectively operated.

Three stop buttons 6L, 6C, and 6R are provided for manipulation by a player on the right side of start lever 12. These stop buttons correspond to the three reels arranged side by side that indicate symbols in display window 3.

At the left side of start lever 12, there is disposed a C/P switch 13 for changing credit/pay-out of medals acquired by the player as a result of the button-pushing operation. By actuation of this switch, medals (not shown) are paid out from a medal outlet 14 disposed beneath the front face of cabinet 2 and received in a medal tray 15.

FIGS. 3 to 6 show various states of indication in display window 3 of FIG. 2. In each of these figures, reference numerals 5A, 5B, 5C, 5D, and 5E represent the five winning lines.

Figure 3:
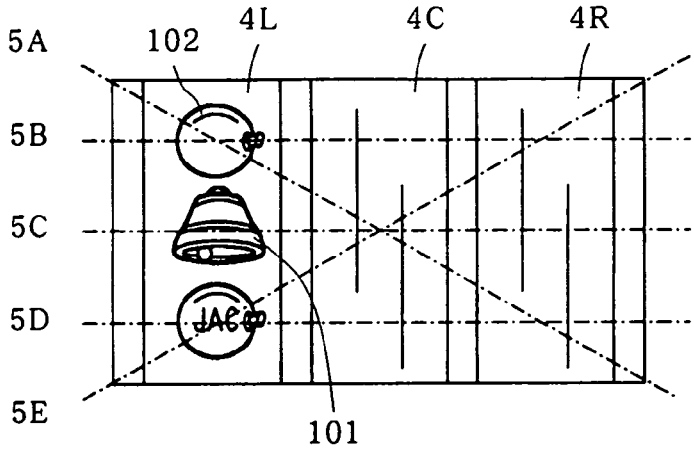
FIG. 3 represents a state of indication in a display portion of the embodiment of FIG. 2 showing a first reel having stopped, and second and third reels still moving.

FIG. 3 represents a state of indication that exists when the player (not shown) has pushed first stop button 6L, illustratively in the case where the player intends to push the stop buttons in order of first stop button 6L, second stop button 6C, third stop button 6R. In this indication state, first reel 4L is stopped, and second reel 4C and third reel 4R are moving. In this example, "plum" symbol 102 is present in the upper section of first reel 4L, and the player therefore can recognize the possibility of hit based on a winning pattern 202 (FIG. 8) which constitutes a combination of three "plum" symbols 102. The player would recognize this possibility of a win because he or she would know that in second reel 4C, which the player intends to stop next, three "plum" symbols 102 are sequentially arranged, as mentioned above. Consequently, the player will endeavor to stop the "plum" symbol 102 at the preferred position.

Figure 4:
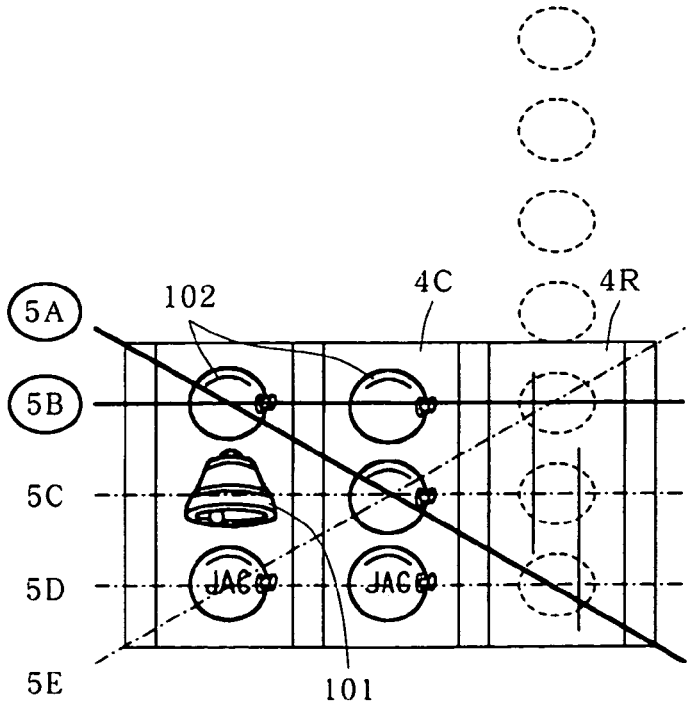
FIG. 4 represents a reach state showing a special "plum" symbol indicated in the display portion of the embodiment of FIG. 2 showing a first reel having stopped, and the third reel still moving.
Figure 8:
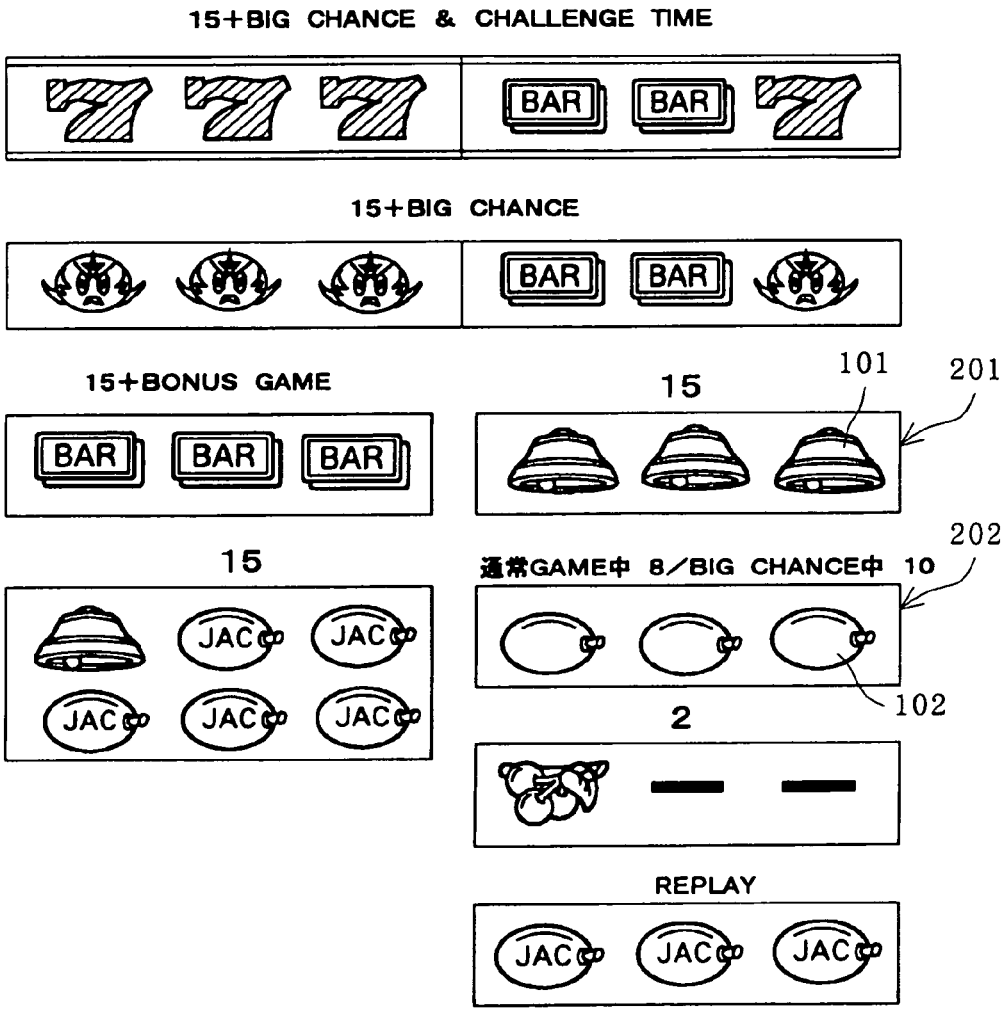
FIG. 8 is a representation of an illustrative award table showing a plurality of winning patterns consisting of combinations of symbols.

If "plum" symbols 102 are positioned at the upper and middle sections of the display window when second reel 4C is stopped, as shown in FIG. 4, "plum" symbols 102 stand in two winning lines 5A, 5B, and consequently, winning pattern 202 shown in FIG. 8 (award table) will be formed on one of winning lines 5A and 5B if a further "plum" symbol 102 can be positioned in the upper or lower section when third reel 4R is stopped. Accordingly, indication of symbols of FIG. 4 corresponds to the expectation of a possible hit condition on two winning lines (termed a "double TENPAI" in this embodiment). In this condition, the player will try to stop the movement of third reel 4R so that "plum" symbol 102 will stop and stand at the upper or lower section of reel 4R.

It is understood by the player that a predetermined plurality of symbols (illustratively four) on each reel can be caused to be displayed in the display window in response to the button-pushing operation. Thus, with respect to third reel 4R of FIG. 4, symbols up to the predetermined number of symbols (i.e., four) above the upper section in the display can be dragged into the display window in response to the button-pushing operation. For example, the player's timing of the button-pushing operation can be effected in response to the presence of a symbol positioned at the lower section to 3+4=7 symbols. Accordingly a win can be achieved even if the timing of the button-pushing operation is off to a limited extent. In other words, the present invention provides an increase in the permissible tolerance of the player's timing of the button-pushing operation.

Figure 5:
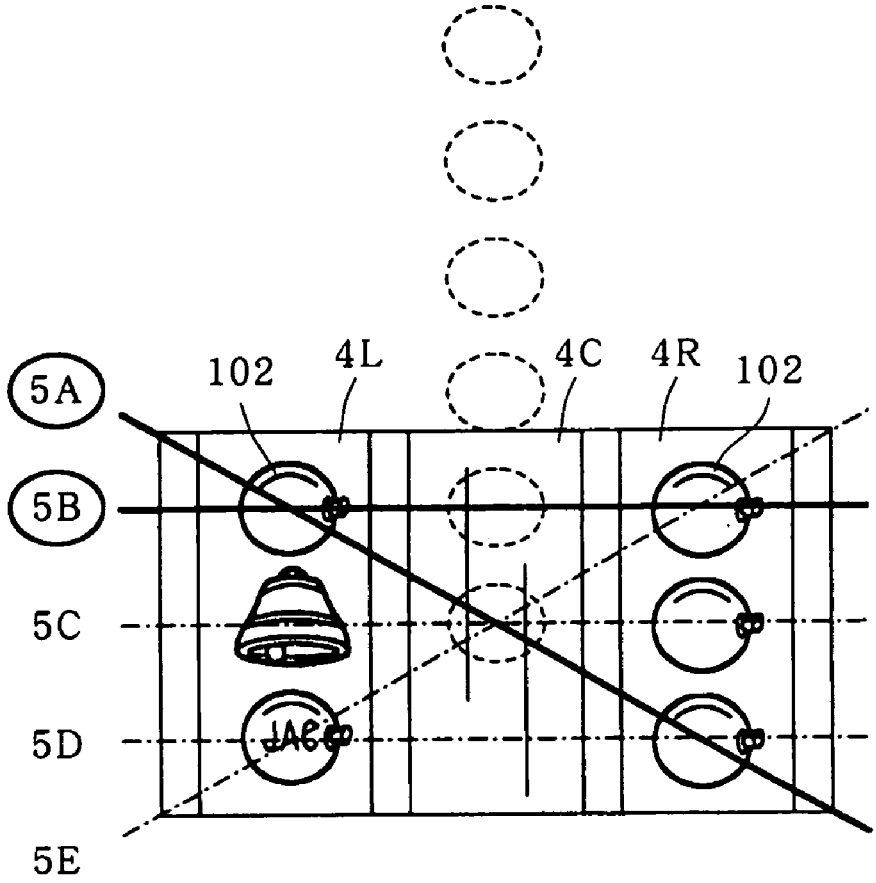
FIG. 5 represents a reach state showing a special "plum" symbol indicated in the display portion of the embodiment of FIG. 2 showing first and third reels having stopped and the second reel still moving.

FIG. 5 shows an example of indication in the case where the player intends to push the stop buttons in the order of stop button 6L, third stop button 6R, and then second stop button 6C. In this specific illustrative embodiment of the invention, third reel sheet 100R of FIG. 1 has been applied to second reel 4C, and second reel sheet 100C has been applied to third reel 4R.

In the state of indication of FIG. 5, the operation of first stop button 6L followed by the operation of third stop button 6R, causes first reel 4L and third reel 4R to be shown as already stopped. With respect to first reel 4L, it is in the same condition as in the example of FIG. 4, wherein"plum" symbol 102 stands in the upper section. In this case, however, the above-mentioned three sequential "plum" symbols 102 stand in all sections of third reel 4R. Thus, two "plum" symbols 102 stand on each of winning lines 5A and 5B. Consequently, winning pattern 202 shown in FIG. 8 (award table) will be formed on winning line 5A or 5B if "plum" symbol 102 becomes positioned at the upper section or the middle section of reel 4C when the movement of second reel 4C is stopped. The indication of symbols of FIG. 5 leads to the expectation of a hit condition on two winning lines (termed a "double TENPAI").

In this condition, the player tries to operate to stop the motion of third reel 4R so that "plum" symbol 102 will stop and stand at the upper or middle section. The timing of the button-pushing operation is permitted from a symbol that is positioned at the middle section to 2+4=6 symbols in the sequence of symbols of reel 4C. Accordingly, as previously discussed, the player's timing tolerance for effecting the button-pushing operation is increased, and a win can be achieved even if the player's timing of button-pushing operation is slightly off.

Figure 6:
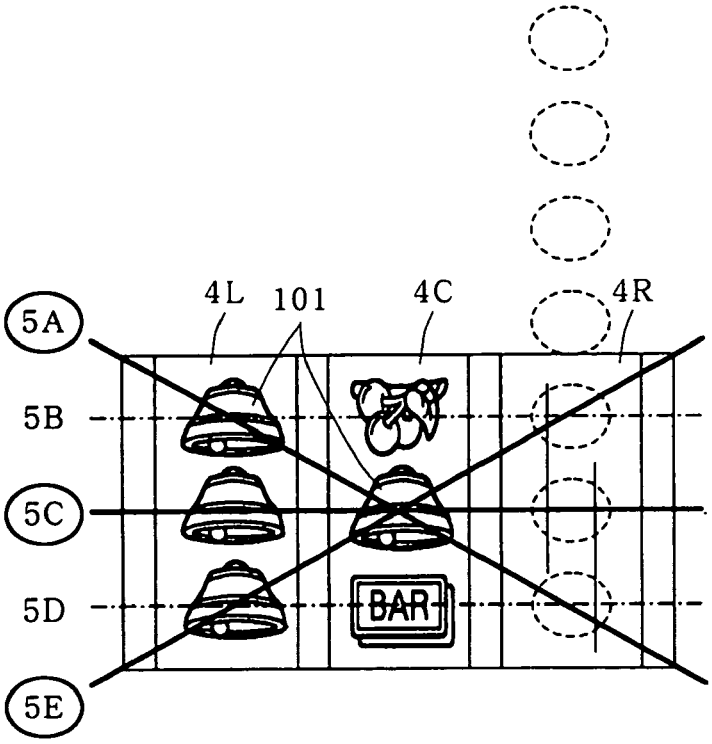
FIG. 6 represents a reach state showing a special "bell" symbol indicated in the display portion of the embodiment of FIG. 2 showing the first and second reels having stopped and the third reel still moving.

FIG. 6 represents a state of indication where the player intends to push the stop buttons in the order of stop button 6L, second stop button 6C, and third stop button 6R (or the second stop button 6C, first stop button 6L, and third stop button 6R). In this indication state, first reel 4L and second reel 4C are stopped by the pushing operation of the first and second stop buttons, 6L and 6C, and therefore third reel 4R is shown to be moving.

In this example, three sequential "bell" symbols 101 are shown to stand in the upper, middle and lower sections of first reel 4L in the display window, and "bell" symbol 101 stands in the middle section of second reel 4C. If "bell" symbol 101 becomes positioned in the upper, middle or lower section when third reel 4R is stopped, winning pattern 201 (FIG. 8 award table), which consists of a combination of three "bell" symbols 101 is formed on winning line 5A, 5C, or 5E, resulting in a "hit." Accordingly, the symbol indication of FIG. 6 establishes that a hit is an expected condition on three winning lines (termed a "triple TENPAI").

In this condition, the player tries to operate the stop button to stop the movement of third reel 4R so that "bell" symbol 101 will stop and stand in any section of the display. The timing of the button-pushing operation is permitted from a symbol positioned at lower section to (3+4=7) seven sequential symbols. Accordingly, also in this case, a win can be obtained even if the player's timing of the button-pushing operation is off to some extent.

As mentioned above, the recognition of a symbol becomes easy for a player by the sequential placement of a plurality of identical symbols, which become special kinds of symbols in the playing of the game. In the case where the above-mentioned CT game is performed, even a beginner player can enjoy a profit that is not inferior to that of a skilled player, because the timing tolerance of the push-button operation is enlarged.

Figure 7:
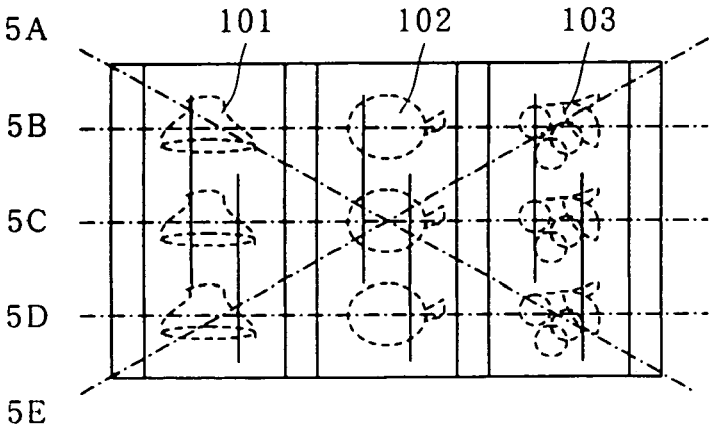
FIG. 7 is a representation showing all reels moving.

As shown in FIG. 7, special kinds of symbols 101,102, and 103, which are shown in dotted line format in the figure, are shown to be respectively sequential. Thus, even if all reels 4L, 4C, and 4R are rotating and symbols are in movement, the player can easily recognize the special kinds of symbols.

The sequential three "cherry" symbols 103 of third reel 4R have no corresponding winning patterns in the award table of FIG. 8. Therefore, if "cherry" symbols 103 are indicated as still in the upper, middle and lower sections, the player cannot obtain any advantageous condition. Thus, the player can try push the stop buttons so as to avoid any "cherry" symbols 103 from stopping in the indication, because "cherry" symbols 103 can be distinguished from the other symbols even during movement. Accordingly, a winning pattern can be achieved when the player operates the stop button of third reel 4R in the state as shown in FIG. 4 or FIG. 6 by avoiding "cherry" symbols 103 from the stop indication.

The sequential three "bell" symbols 101 and the sequential three "plum" symbols 102 not only have direct effect in facilitating the arrangement of a winning combination of symbols, but also have indirect effect in facilitating the other winning combinations of symbols shown in the award table of FIG. 8. That is, more advantageous winning combinations of symbols such as all "7" symbols, all "character" symbols or the like are achieved by avoiding "bell" symbol 101 and "plum" symbol 102 from the stop indication, in a manner similar to the avoidance of "cherry" symbols 103, mentioned hereinabove.

FIG. 8 is a specific illustrative example of an award table showing a plurality of symbol combinations that form winning patterns. This figure also shows an example of a scheme of allotment number of medals that are associated with respective wins. In a preferred embodiment, this table is displayed on cabinet 2 of slot machine 1 at a position convenient for the player to see.

In the above-mentioned example, the display for gaming of the present invention is applied to a slot machine or pachinko gaming machine having a display portion formed of rotatable reels. The present invention can also be applied to other gaming machines, such as a slot machine having electrical display equipment or a TV gaming machine having image equipment.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A display for a game comprising:

a plurality of independently rotatable reels, rotatable about a common axis;

a respective reel sheet attached peripherally to each of the reels, each reel sheet including a plurality of symbols sequentially arranged, for viewing by a player upon stopping of rotation of the corresponding reel, wherein each of the reel sheets includes one symbol appearing serially, at least two times, without any intervening different symbol, and each symbol of the plurality of symbols appears on each of the reel sheets; and a display window for viewing symbols on the reels along each of at least two straight lines when the reels are stopped, wherein alignments on at least one of the lines of any of specific combinations of the symbols provide a winning state for the player and all other combinations of the symbols on the straight lines do not provide a winning state for the player.

2. The display for a game according to claim 1 wherein the display window provides for viewing of the symbols, when the reels are stopped, along three straight lines, and alignments on at least one of the three straight lines of any of the specific combinations of the symbols provide a winning state for the player and all other combinations of the symbols on the three straight lines do not provide a winning state for the player.

3. The display for a game according to claim 2 wherein the display includes three reels.

4. The display for a game according to claim 3 wherein any of the specific combinations of three of the symbols aligned on diagonal lines, oblique to the common axis, a winning state for the player and all other combinations of the symbols on the diagonal lines do not provide a winning state for the player.

5. The display for a game according to claim 4 wherein one of the symbols appearing serially at least two times, without any intervening different symbol, on at least one of the reels, is part of at least one of the specific combinations providing a winning state for the player when the symbol appears on one of the diagonal lines.

6. The display for a game according to claim 4 wherein one of the symbols appearing serially at least two times, without any intervening different symbol on at least one of the reels, is part of at least one of the combinations not providing a winning state for the player when the symbol appears on one of the diagonal lines.

7. The display for a game according to claim 1 wherein the symbols on each reel appearing at least two times without any intervening different symbol, appear three times on each reel serially, without any intervening different symbol.

8. The display for a game according to claim 1 wherein each of the symbols appearing serially on each of the reels at least two times without any intervening different symbol are different in color on each reel.

9. The display for a game according to claim 1 wherein each of the symbols appearing serially on each of the reels at least two times without any intervening different symbol is different on each of the reels.

10. The display for a game according to claim 1 wherein one of the symbols appearing serially at least two times, without any intervening different symbol, on at least one of the reels, is part of at least one of the specific combinations providing a winning state for the player when the symbol appears on one of the straight lines.

11. The display for a game according to claim 1 wherein one of the symbols appearing serially at least two times, without any intervening different symbol, on at least one of the reels, is part of at least one of the combinations not providing a winning state for the player when the symbol appears on one of the straight lines.

12. The display for a game according to claim 1 wherein each symbol that appears serially at least two times, without any intervening different symbol on one of the reels, also appears on each of the other reels, but not serially without any intervening different symbol.

13. The display for a game according to claim 1 further including a cabinet housing the reels and on which an award table showing the specific combinations of the symbols providing a winning state is displayed for viewing by the player.

14. The display for a game according to claim 1 wherein the at least two straight lines are parallel to the common axis.

15. The display for a game according to claim 1 wherein the at least two straight lines are oblique to the common axis.

16. The display for a game according to claim 1 wherein the specific combinations of the symbols providing a winning state include any one of the symbols of the plurality of symbols that appears identically along any of the straight lines of the display window without interruption by any other symbol.

* * * * *